US006774271B2

(12) United States Patent
Jiang

(10) Patent No.: US 6,774,271 B2
(45) Date of Patent: Aug. 10, 2004

(54) METHOD AND SYSTEM OF CONVERTING WASTE PLASTICS INTO HYDROCARBON OIL

(76) Inventor: Tianfu Jiang, Zao Jun Xi Li, Bldg. No. 2, Apt. 1-501, Haidian District, Beijing 100081 (CN)

( * ) Notice: Subject to any disclaimer, the term of this patent is extended or adjusted under 35 U.S.C. 154(b) by 211 days.

(21) Appl. No.: 09/807,186

(22) PCT Filed: Jan. 22, 2001

(86) PCT No.: PCT/CN01/00099

§ 371 (c)(1),
(2), (4) Date: Apr. 10, 2001

(87) PCT Pub. No.: WO02/057391

PCT Pub. Date: Jul. 25, 2002

(65) Prior Publication Data

US 2002/0156332 A1 Oct. 24, 2002

(51) Int. Cl.[7] ..... C10G 1/00; C10G 1/10; C08J 11/00

(52) U.S. Cl. ..... 585/241; 585/240; 201/2.5; 201/25

(58) Field of Search ..... 585/240, 241, 585/242; 201/2.5, 25

(56) References Cited

U.S. PATENT DOCUMENTS

| | | | | | |
|---|---|---|---|---|---|
| 4,851,601 | A | * | 7/1989 | Fukuda et al. | 585/241 |
| 4,983,278 | A | * | 1/1991 | Cha et al. | 208/407 |
| 5,368,723 | A | * | 11/1994 | Takahashi et al. | 208/427 |
| 5,608,136 | A | * | 3/1997 | Maezawa et al. | 588/228 |
| 5,731,483 | A | | 3/1998 | Stabel et al. | |
| 5,735,948 | A | * | 4/1998 | Cha et al. | 106/724 |
| 5,744,668 | A | * | 4/1998 | Zhou et al. | 585/241 |
| 6,133,491 | A | * | 10/2000 | Xing | 585/241 |
| 6,172,275 | B1 | * | 1/2001 | Tadauchi et al. | 588/228 |

FOREIGN PATENT DOCUMENTS

| | | | |
|---|---|---|---|
| CN | 1016072 | | 4/1992 |
| CN | 1075328 | | 8/1993 |
| CN | 1077479 | | 10/1993 |
| CN | 1126237 | | 7/1996 |
| CN | 1130652 | | 9/1996 |
| CN | 1236804 | | 12/1999 |
| EP | 0 607 862 | A1 * | 7/1994 |
| WO | WO 00/64997 | * | 11/2000 |

* cited by examiner

*Primary Examiner*—Walter D. Griffin
(74) *Attorney, Agent, or Firm*—Timothy J. Keefer; Seyfarth Shaw LLP

(57) ABSTRACT

A system and method of converting waste plastics into hydrocarbon oil comprises a thermal cracking reactor, into which the waste plastics are cracked at a temperature in the range of 270–800° C. to obtain partly gaseous hydrocarbons, partly liquid hydrocarbons, and remaining residues. A continuous thermal cracking and residual discharging portion is connected to have the liquid hydrocarbons gradually and fully cracked into gaseous hydrocarbons, while the residues are discharged at a residual discharge outlet. A chlorine removal portion is connected to receive the gaseous hydrocarbons to remove chlorine from it. A catalytic cracking reactor is connected to the chlorine removal portion to have the gaseous hydrocarbons catalytic cracking with an acid catalyst. A three-stage cooling portion is adopted to have the catalytically cracked gaseous hydrocarbons fully converted into liquid hydrocarbons, i.e., hydrocarbon oil. A pressurized activation reaction portion is provided to remove few amount of S. N. P. from the liquid hydrocarbons to obtain purified hydrocarbon oils.

25 Claims, 3 Drawing Sheets

METHOD AND SYSTEM OF CONVERTING WASTE PLASTICS INTO HYDROCARBON OIL

CROSS REFERENCE TO RELATED APPLICATION

This application claims the priority of PCT application Ser. No. PCT/CN01/00099 filed on Jan. 22, 2001.

FIELD OF THE INVENTION

The present invention relates to a plastic oil extraction technology, and more particularly to a method of converting waste plastics into hydrocarbon oil, and a system for carrying out the same.

BACKGROUND OF THE INVENTION

The plastic oil extraction technology, or POET in short, has been used in processing solid wastes generated in urban areas and in industries. However, as noted in the research, it appears that there is still no practically applicable method and system of converting waste plastic into hydrocarbon oil. Most of the researchers in this particular field focus on the conversion of high polymer compositions into polymers of smaller molecules by utilizing thermal cracking of high temperature and high pressure, catalysts, while the operation platform used is either an oven type reactor or tubular type reactor. It is believed that the former reactor may be good for melting the solid plastics, but may not ensure the sufficient cracking, and discharge the residues efficiently, while the latter reactor is just opposite. The tubular reactor may efficiently discharge the residues of the cracking, but may not be suitable for processing directly the solid waste plastics.

The plastic oil extraction technology of prior art usually includes thermal cracking, catalytic cracking, and cooling. One of the prior methods and systems is disclosed in EP 0 607 862 A. In order to obtain purified hydrocarbon oil, it utilizes a neutralization tank, in which the low-boiling hydrocarbon oil is subjected to neutralization in a 20% sodium hydroxide aqueous solution, and an oligomerization tank, in which the cracking gas component is subjected to oligomerization in a 100% phosphoric acid in addition to the aforesaid thermal, catalytic cracking and cooling. The other prior method or system is disclosed in WO 00/64997 of the same inventor, Mr. Tianfu JIANG. In that system, a subsidiary reactor is used to have the residues of the main thermal cracking reactor undergone a secondary thermal cracking so as to ensure the waste plastics gasified, and a heavy oil separator is used to recycle the heavy oil back to the catalytic cracking reactor for further catalytic cracking.

However, the POET is aimed to process a mixture of hardly defined wastes plastics, containing many non-recyclable plastics, such as PP, PE, PVC, PET, PS, etc. in urban and industrial plastic wastes. Therefore, the conversion process from the solid wastes into a gaseous state can be hardly controlled. Thus, it creates lots of difficulties in the industrial application. This is probably the main reason why the plastic oil extraction technology has not been really put into practical use. The present invention is developed and perfected through many years of industrial research and practical testing. The present invention has solved the aforesaid difficulties, and thus can be readily adopted in the industrial application.

An object of the present system is to provide a method and system of converting the solid plastic wastes efficiently and thoroughly into pure and clean hydrocarbon oils of high calorie value up to about 11000 great calories per kilograms, and of a weight ratio of about 0.8. Such hydrocarbon oils can be used on any types of oil injection nozzle, and thus it can be widely used in the industry.

Another object of the present invention is to provide a system utilizing the combination of an oven reactor and a tubular reactor such that it can process various kinds of plastic wastes.

A still further object of the present invention is to provide a method and system of converting the solid plastic wastes into hydrocarbon oil without hazard hydrochloric acid.

SUMMARY OF THE INVENTION

In accordance with the present invention, a system of converting waste plastics into hydrocarbon oils comprises a thermal cracking reactor, into which solid waste plastics are fed and in which said waste plastics are cracked at a temperature in a range of 270–800° C. to obtain a thermal cracking product of partly gaseous hydrocarbons, partly a mixture of liquid hydrocarbons and residues; a continuous thermal cracking and residual discharging portion connected to receive automatically the mixture of liquid hydrocarbons and residues from the thermal cracking reactor, in which the liquid hydrocarbons are gradually and cracked into gaseous hydrocarbons when passing through the thermal cracking and residual discharge portion, while the dry residues from the previous thermal cracking and residues newly generated from the farther thermal cracking are discharged at a residual discharge outlet of the thermal cracking and residue discharge portion; a [hydrochloride] hydrochloric acid removal portion connected to receive the gaseous hydrocarbons, respectively, from the thermal cracking reactor and from the continuous thermal cracking and residual discharge portion; a catalytic cracking reactor being connected to the hydrochloride removal portion in which the gaseous hydrocarbons from the hydrochloride removal portion is subjected to catalytic cracking with an acid catalyst; a cooling portion through which most of the gaseous hydrocarbons after the catalytic cracking are substantially converted into liquid hydrocarbons, and remaining non-convertible gaseous hydrocarbon substances are transported back to a burning chamber which compensates the heating of the thermal cracking reactor; and an pressurized activation reaction portion provided to receive the liquid hydrocarbons from the cooling portion to solidify few amount of sulfur nitrogen phosphorus contained in the liquid hydrocarbons so as to obtain purified hydrocarbon oils, thereby reducing the generation of SOx and NOx.

The thermal cracking and residual discharge portion consists of continuous thermal reacting tubes of parallel arrangement. A mixture of the melting waste plastics and other impurities, that is, liquid hydrocarbons and residues, is pushed forward by screw conveyors mounted inside the tubes, and thus passes through the thermal reacting tubes while the mixture is maintained at a high temperature sufficient to enable further gasification of the melting wastes plastics, or rather liquid hydrocarbons, to ensure the sufficient thermal cracking of the gaseous hydrocarbons.

The hydrochloride removal reaction of the present invention is to have the thermal cracking products, i.e., gaseous hydrochloric acid, in reaction with alkaline substances to replace the chlorine from hydrochloric acid contained in the thermal cracking products so as to obtain purified gaseous hydrocarbons. The hydrochloride removal reaction is at a high temperature. After the reaction, the gaseous hydrocarbons are hydrochloric acid free.

The cooling portion of the present invention consists of three stages of cooling, whereby gaseous alkene of large molecules will be substantially converted into gaseous alkene of small molecules, such as eight to twenty carbon atoms, and eventually become liquid hydrocarbons, leaving only few non-convertible gaseous hydrocarbon substance, that is, non-convertible at room temperature and pressure. Such non-convertible gaseous hydrocarbon substances will be sent back to the burning chamber for the thermal cracking reactor to compensate the heating supply for the thermal cracking reaction.

DETAILED DESCRIPTION OF THE INVENTION

The raw waste materials are usually urban and industrial waste plastics, that normally contain many non-recyclable plastics, such as PP, PE, PVC, PET, and PS, etc. For recycling those waste plastics, some kinds of pretreatment may be required. Usually, such waste plastics are sorted roughly at individual homes or wastes collection sites before they are brought to a recycling plane. At the recycling plane, the waste plastics are subjected to separation by one or more separator. There are normally magnetic selection separators and air-blowing selection separators. The magnetic selection is primarily for separating the relatively big metal wires, or other metal parts, while the air-blowing (or wind) selection is primarily for separating dust or dirt contained in the wastes, and reducing water contents.

After the pretreatment, the waste plastics are sent to the system of the present invention. Such a system usually contains a material feeding system (not shown) to prevent the feeding materials from spilling out, and prevent the gas seepage from the reactors to avoid any ignition of burning and explosion. The feeding system may use an automatic piston of hydraulic pressure control that does not require crashing the waste materials, or use a screw-propelling feeding system that requires crashing the wastes materials before feeding. The latter system may reduce the dust or dirt in the processed waste materials.

Figure 1:
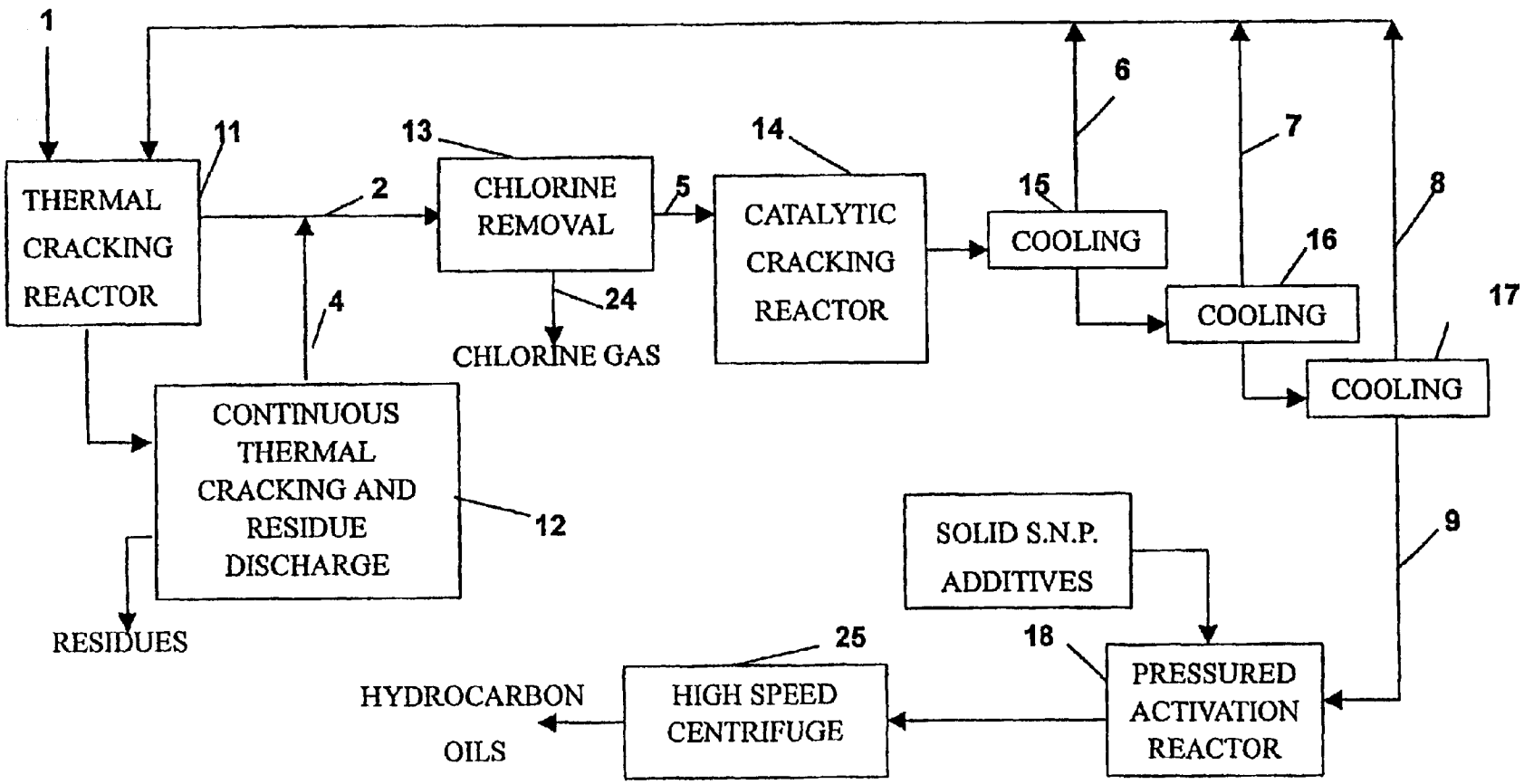
FIG. 1 is an illustration of a system in accordance with the present invention.

Then, the waste plastics enter the thermal cracking reactor 11 through the feeding system at the feeding entry I with reference to FIG. 1. The thermal cracking reactor 11 is an oven type reactor, and it is a cylindrical and sealed container made of titanium steel. The outside of the thermal cracking reactor 11 is normally provided with a heating furnace sleeve (not shown) and an automatic ignition system (not shown) in association with the heating furnace. The temperature inside the thermal cracking reactor is controlled at 270–800° C., and the pressure inside the oven reactor is the environmental atmosphere or pressure. Once the waste plastics get into the reactor, they start the thermal cracking reaction at 270–800° C., and the molecule chains of the plastics are gradually broken. The practical test shows that 30% of the solid waste plastics become gasified soon after they become liquid in the thermal cracking reactor 11 at a matter of few seconds. Thus, the thermal cracking products are about 30% gaseous hydrocarbons, as well as about 70% of a mixture of non-gasified liquid hydrocarbons substances and other residues, that is, melting waste plastics.

As shown in FIG. 1, the mixture of gaseous hydrocarbons substances and residues, the melting waste plastics, are led from the thermal cracking reactor 11 to a hydrochloric acid removal portion 13, while the melting waste plastics are passed to the continuous thermal cracking and residual discharging portion 12 that is a tubular thermal reactor. In the 70% melting plastics are mixed of various impurities, such as carbonized material and dirt etc. These melting plastics pass uniformly through the heated continuous thermal cracking and residual discharging portion that consists of several sets of reacting tubes of acid resistant, i.e., so-called tubular type of reactor. This portion also functions as a residual discharging system. During this process, the inside temperature of the reacting tubes is maintained at 270–800° C. to ensure fully thermal cracking reaction.

Figure 2:
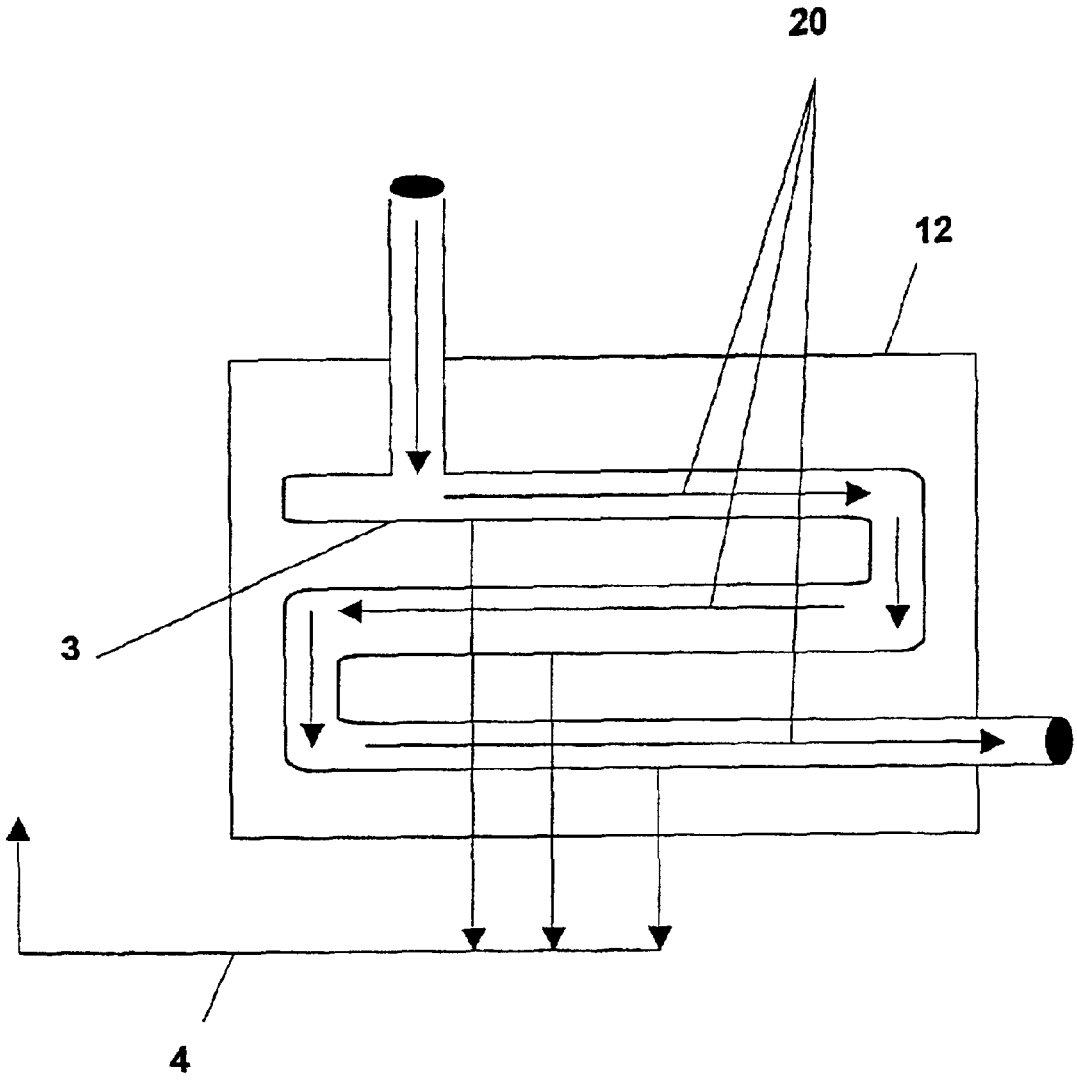
FIG. 2 illustrates the structure of the continuous thermal cracking and residual discharge portion of the present invention.

With reference to FIG. 2, the tubular thermal cracking and residual discharging portion 12 comprises a plurality, such as five or six, sets of steel tubes 3 of predetermined length that are parallel arranged. The screw propellers or conveyors 20 mounted inside the steel tubes rotate at opposite directions in adjacent tubes, and the entire portion 12 is placed within a heating sleeve with a temperature at 270–800° C. The metal screw propellers or conveyors propel the melting plastics forward such that the 70% melting plastics pass the heated tubes and the residues enter the residual discharging system. As accurately calculated, the length of the tubes 3 and the rotation speed are set such that the melting liquid plastics pass the whole system at a predetermined speed such that the melting plastics are fully gasified before reaching to the end of the continuous thermal cracking and residual discharging portion 12, and the gaseous thermal cracking products are led out of a gas outlet 4 to the hydrochloric acid removal portion 13. The impurities in the melting plastics become powder substances to be eventually discharged at the other outlet of the continuous thermal cracking and residual discharging portion. The stability and continuity of the industrial production are maintained by the continuous and constant feeding of the materials.

Figure 3:
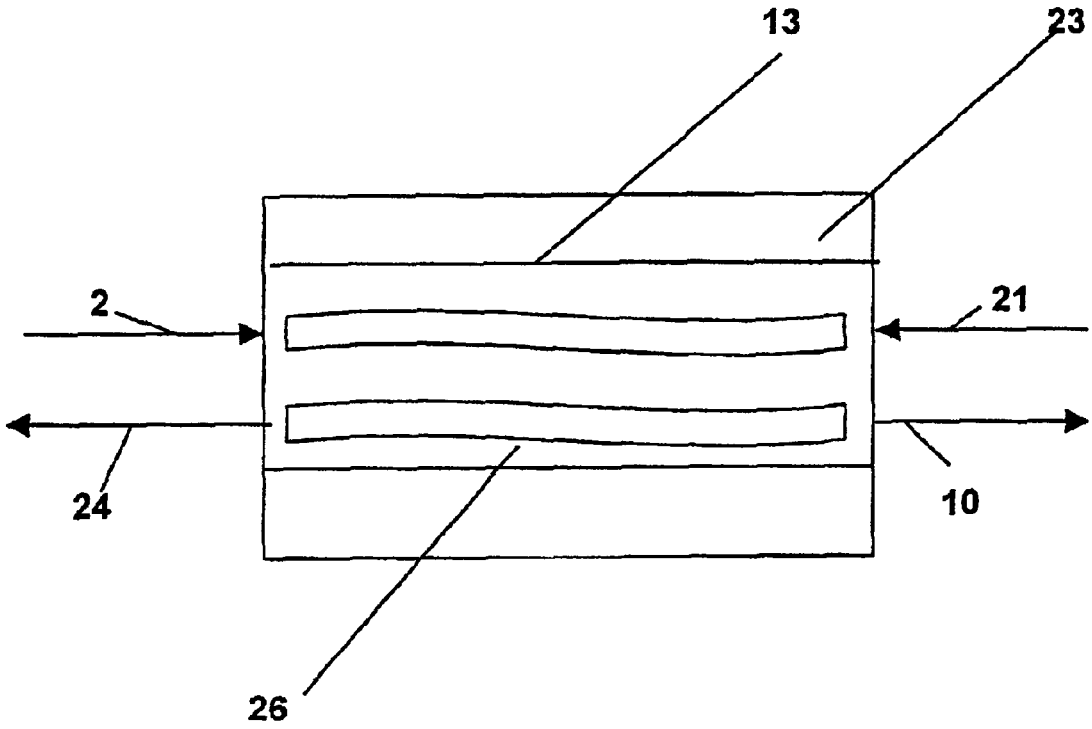
FIG. 3 is an illustration of the structure of the chlorine removal portion.

The hydrochloric acid removal portion 13 of the present invention is shown in FIG. 3. The art used here is different from the dry or damp neutralization method currently used in the industry. This is a new technology of hydrochloric acid removal at high temperature, whereby the existence of hydrochloric acid in the gaseous hydrocarbons is minimized or almost eliminated. The catalysts are made of several alkaline compounds and heavy metal elements to form metallic substances, and they are reusable so as to increase the side products, chlorine gas ($Cl_2$), and reduce the cost.

In the gaseous hydrocarbons of high temperature generated from the thermal cracking reactor and the continuous thermal cracking and residual discharging portion, there could be certain amount of hydrochloric acid. As studies show, there are about 5–15% plastics among the urban solid wastes, and about 5% of the plastic wastes are PVC. The PVC materials are hard to be separated from other plastic wastes, if mixed, and the PVC will generate HCl through thermal cracking. The aforesaid gaseous hydrocarbons pass the acid-resistant pipelines. The temperature of the hydrochloric acid removal system 13 is maintained at 270–800° C. Because of the effect of the metallic substances, the gaseous hydrochloric acid in the gaseous hydrocarbon substances will become solidified rapidly so as to ensure that the amount of hydrochloric acid in the gaseous hydrocarbons is almost zero, i.e., hydrochloric acid free.

As shown in FIG. 3, the gaseous hydrocarbons and the mixed few amount of hydrochloric acid pass the pipeline 2

(FIG. 1), and enter the hydrochloric acid removal portion 13. Then they react with the specific metallic substances 26 under the condition of a temperature of 270–800° C. to have the chloride ion solidified to form compounds. Other gaseous hydrocarbon substances will enter through a pipe 10 into a setting bed 22. The outer portion 23 of the hydrochloric acid removal portion 13 is a heating sleeve, provided to maintain the condition of removing hydrochloric acid, i.e., the high temperature. As accurately calculated, it is possible to have the metallic substances saturated within a predetermined time interval. In this case, the pipeline 2 can be switched to another identical hydrochloric acid removal portion. The reaction state is the same as that discussed above.

At the same time, the first hydrochloric acid removal portion receives hot air through the pipeline 21 to react with the metallic substances. The chlorine element contained therein will be replaced and changed into chlorine gas, and then expelled, through the pipe 24, together with the hot air out of the hydrochloric acid removal portion 13. Then, the expelled gas enters the chlorine separation system to collect chlorine gas.

Upon leaving the hydrochloric acid removal portion 13, the gaseous hydrocarbons enter a catalytic cracking reactor 14. The gaseous hydrocarbons of high temperature, under the effect of a special catalyst, will be rapidly cracked again into gaseous hydrocarbons substances of much smaller molecule compositions. More specifically, the catalyst can be repeatedly used to reduce the cost.

The cooling portion of the present invention includes a three-stage cooling and condensing 15, 16, 17. The gaseous hydrocarbons coming out of the catalytic cracking portion have undergone the cracking reaction twice, respectively, in the thermal cracking reaction and the catalytic cracking reaction. The big molecules of the gaseous hydrocarbons may have been completely broken up so as to obtain gaseous hydrocarbon of smaller molecules, such as eight to twenty carbon atoms. Then, after the three-stage cooling and condensing, about 85–90% of the gaseous hydrocarbons become liquid hydrocarbons, i.e., hydrocarbon oils, while the remaining substances will pass through the pipelines 6, 7, 8 (FIG. 1) and be lead, through a LPG recovery system, into a burning chamber (not shown) to compensate the heating of the thermal cracking reactions. The aforesaid remaining substances are non-convertible hydrocarbon substances that can only be gaseous under the normal temperature and pressure, such as methane, butane, etc.

The system of the present invention further includes a pressurized activation reactor 18. This reactor provides 0.8–1 atmosphere and normal temperature as the reaction conditions, and adds special additives to enhance the fluidity of the hydrocarbon oils, to have the hydrocarbon oils further cracked (cold cracking), and to increase the calorie value of the resulting hydrocarbon oils. In the meantime, due to the effect of the additives, a small amount of sulfur, nitrogen, phosphorus elements contained in the liquid hydrocarbons are solidified so that the resulting hydrocarbon oils become highly purified. A high-speed centrifuge 25 may be adopted to extract the purified hydrocarbon oils (FIG. 1).

The method of the present invention is described hereinafter. The waste plastics are fed into the thermal cracking reactor 11 through the material entry 1. The thermal cracking reaction is carried out in an oxygen free environment, at a temperature of 270–800° C., and under the environmental atmosphere pressure. It is confirmed that about 30% of the solid waste plastics become gaseous products soon after they become liquid. Then, the thermal cracking resulting gas passes through the pipeline 2 and enters into the hydrochloride removal portion 13.

The remaining 70% melting liquid plastics in the thermal cracking reactor 11 are mixed with impurities, and pass through a control valve (not shown) at the bottom outlet of the thermal cracking reactor 11, entering into the continuous thermal cracking and residual discharging portion 12. The melting plastics flow gradually through the tubes 3 (FIG. 2) of the continuous thermal cracking and residual discharging portion 12. There, the melting liquid plastics are further thermally cracked, and become gasified. The thermal cracking resulting gaseous hydrocarbon substances enter the hydrochloric acid removal portion 13 through the pipeline 4.

With the completion of the gasification at the end of the continuous thermal cracking and residual discharging portion 12, the dry residuals are expelled through the metal screw conveyors 20 inside the tubes 3. Through the pipelines 2 and 4, the gaseous hydrocarbon substances after the thermal cracking enter into the hydrochloric acid removal system 13. The special metallic substances will capture the chloride ion of the gaseous hydrochloric acid to generate chlorine gas. The resulting chlorine gas is expelled out of the removal portion 13. Then, the gaseous hydrocarbons are hydrochloric acid free. The gaseous hydrocarbons substances pass through the pipeline 5 and enter the catalytic cracking reactor 14. In the catalytic reactor 14, the gaseous hydrocarbon are catalytically under the effect of an acidic catalyst to become light groups of gaseous hydrocarbon substances of small molecules. Then, the catalytic cracking products enter the three cooling and condensing stages 15, 16, 17 to obtain liquid hydrocarbons of small molecules.

When the gaseous hydrocarbon substances pass the through three cooling stages, any gaseous hydrocarbon substances, that may become liquid hydrocarbons, will change into the liquid hydrocarbons. These are the basic extracted oil components. Most of them, however, are unsaturated alkene substances. At the normal temperature and pressure, the still gaseous hydrocarbons substances are non-convertible LPG. These non-convertible gaseous hydrocarbons or LPG will be returned through the pipelines 6, 7, 8 and LPG recovery system to the burning chamber for the thermal reaction or return to the heating furnace sleeve of the thermal cracking reactor 11 to compensate the heating capacity.

The collected liquid hydrocarbons pass through the pipeline 9 and an oil pump (not shown), and then enter the activation reactor 18. Under the reaction condition of 0.8–1 atmospheres, a special industrial additive is added into the activation reactor 18. There, few amount of sulfur, nitrogen, phosphorus elements contained in the liquid hydrocarbons become solid, while the liquid hydrocarbons get further cracked (cold cracking) to increase the percentage of the saturated hydrocarbons. Then, these saturated hydrocarbons become purified and clean light hydrocarbon oils of high fluidity and high calorie value.

In accordance with the present invention, the removal of hydrochloric acid is carried out at a high temperature. It is believed that such hydrochloric acid removal is not known before, that is, removing hydrochloric acid at a high temperature, for instance, 270–800° C. The hydrochloric acid mixed in the gaseous hydrocarbons of high temperature forms an acidic mixture of high temperature. The hydrochloric acid is removed first to ensure that the gaseous hydrocarbons enter the setting bed (molecule sieve) safely without damaging the catalyst therein. Here, the metallic substances can be recycled for repeated use to reduce the cost.

The conventional technique of hydrochloric acid removal is based on dry method or damp method. The principle is the neutralization of acid and alkaline. Such a method would require a large amount of calcium oxide in case there is a large amount of hydrochloric acid. At the same time, it would generate a large amount of calcium chloride. Therefore, in practice, it may create some troubles during the transportation, additional resultants, and other technical treatment difficulties. Thus, it would increase the operation cost.

When removing hydrochloric acid at a high temperature, the specific catalyst may replace the chlorine through certain oxidation after it absorbs the chloride ion. Thus, it not only reduces the operation cost, but also avoids the generation of the large quantity of useless inorganic salt. Further the cost may be reduced because there is no large amount of alkaline neutralizers required, and no need to deal with the large amount of generated inorganic salt. Moreover, there is no useless product. The resulted chlorine gas is still of marketable value.

The scope of protection of the present invention is set out in the following claims. However, any obvious modification without excess of essence of the present invention should also be within the scope of the present invention.

What is claimed is:

1. A system of converting waste plastics into hydrocarbon oil, said system comprising:

(1) an oven thermal cracking reactor, into which solid waste plastics are fed and in which said waste plastics are cracked at a temperature in a range of 270–800° C. to obtain a thermal cracking product of partly gaseous hydrocarbons and partly a mixture of liquid hydrocarbons and residues;

(2) a catalytic cracking portion coupled to receive said gaseous hydrocarbons, in which the gaseous hydrocarbons are cracked with an acidic catalyst;

(3) a cooling portion in which the gaseous hydrocarbons after the catalytic cracking are substantially converted into liquid hydrocarbons of smaller molecules, and remaining non-convertible gaseous hydrocarbon substances are transported back to compensate the heating of the thermal cracking reactor; and (4) tubular continuous thermal cracking and residual discharging portion being connected to receive the mixture of liquid hydrocarbons and residues from said thermal cracking reactor, such that the liquid hydrocarbons are gradually thermally cracked into gaseous hydrocarbons when passing through the tubular continuous thermal cracking and residual discharging portion, while the dry residues from the previous thermal cracking and residues generated from the further thermal cracking are discharged at a residual discharge outlet of the continuous thermal cracking and residual discharging portion.

2. The system of claim 1, further comprising a hydrochloric acid removal portion connected before the catalytic cracking portion to receive the gaseous hydrocarbons, respectively, from the thermal cracking reactor and the continuous thermal cracking and residual discharging portion, in which the gaseous hydrocarbons are subject to reaction with an alkaline metallic substance at a high temperate said catalytic cracking reactor being connected to said hydrochloric acid removal portion to receive the chlorine-free gaseous hydrocarbons and having said gaseous hydrocarbons subjected to catalytic with said acid catalyst.

3. The system of claim 1, further comprising a pressurized activating reaction portion provided to receive said liquid hydrocarbons from the cooling portion to solidify sulfur, nitrogen, and phosphorus contained in said liquid hydrocarbons so as to obtain purified hydrocarbons oils.

4. The system of claim 1, wherein said continuous thermal cracking and residual discharging portion comprises a plurality of sets of reaction tubes arranged in parallel with one another, in which screw conveyors are provided, each screw conveyer rotating in an opposite direction with the rotation of adjacent screw conveyors such that the mixture of liquid hydrocarbons and residues is pushed continuously forward from the beginning of the tubes to the tubes, while all of the liquid hydrocarbons are gasified, and the residues are discharged from a residual discharging outlet.

5. The system of claim 2, wherein said hydrochloric acid removal action is carried out at a temperature of 270–800° C., chloride ion being replaced from hydrochloric acid contained in said gaseous hydrocarbons and the resulting chlorine gas being expelled out of the hydrochloric acid removal portion.

6. The system of claim 1, wherein said cooling portion comprises three stages, through which most of the catalytically cracked gaseous hydrocarbons are converted into liquid hydrocarbons, while certain gaseous hydrocarbons that are non-convertible at room temperature and pressure are collected and transported back to compensate the heating capacity of the thermal cracking.

7. A system of converting waste plastics into hydrocarbon oil, said system comprising:

(1) an oven thermal cracking reactor, into which solid waste plastics are fed and in which said waste plastics are cracked at a temperature in a range of 270–800° C. thermal cracking product of partly gaseous hydrocarbons and partly a mixture of liquid hydrocarbons and residues;

(2) a catalytic cracking reactor being connected to receive the gaseous hydrocarbons and having said gaseous hydrocarbons subjected to catalytic cracking with an acid catalyst;

(3) a cooling portion in which the gaseous hydrocarbons after the catalytic cracking are substantially converted into liquid hydrocarbons of smaller molecules and remaining non-convertible gaseous hydrocarbon substances;

(4) a tubular continuous thermal cracking and residual discharging portion being connected to receive the mixture of liquid hydrocarbons and residues from the thermal cracking reactor, in which the liquid hydrocarbons are gradually and cracked into gaseous hydrocarbons when passing through the tubular continuous thermal cracking and residual discharge portion, while the dry residues from the previous thermal cracking and residues newly generated from the further thermal cracking are discharged at a residual discharge outlet of the continuous thermal cracking and residual discharge portion; and (5) a hydrochloric acid removal portion being connected to receive the gaseous hydrocarbons, respectively, from the thermal cracking reactor and from the continuous thermal cracking and residue discharging portion.

8. The system of claim 7, wherein a pressurized activation reaction portion is provided to receive the liquid hydrocarbons from the cooling portion to solidify sulfur, nitrogen, and phosphorus contained in the liquid hydrocarbons so as to obtain purified hydrocarbon oils.

9. The system of claim 7, wherein the thermal cracking and residual discharging portion comprises a plurality of continuous reacting tubes of parallel arrangement, and screw-propelling conveyors mounted inside the tubes, wherein the mixture of the liquid hydrocarbons and residues is pushed forward by said screw conveyors, and passes through the reaction tubes, while the mixture is maintained at a high temperature sufficient to enable complete gasification of the liquid hydrocarbons.

10. The system of claim 7, wherein, in said hydrochloric acid removal portion, the thermal cracking products is in reaction with alkaline substances to replace the chlorine from the hydrochloric acid contained in the thermal cracking resultants so as to obtain purified gaseous hydrocarbons, and the hydrochloric acid removal reaction is carried out at a high temperature in a range of 270–800° C.

11. The system of claim 7, wherein the cooling portion comprises three stages of cooling, whereby the catalytically cracked gaseous hydrocarbons are substantially converted into liquid hydrocarbons of smaller molecules of eight to twenty carbon atoms, with gaseous hydrocarbon substances equal to or less than four carbon atoms remaining.

12. The system of claim 11, wherein said gaseous hydrocarbons become said liquid hydrocarbons through said three cooling stages, and said few gaseous hydrocarbon substances that are non-convertible at room temperature and pressure are returned to the thermal cracking reactor and continuous thermal cracking and residual discharge portion to compensate the heating supply for the thermal cracking reaction.

13. A method of converting waste plastics into hydrocarbon oil, said method comprising the following steps of:

(1) feeding solid waste plastics into an oven thermal cracking reactor;

(2) subjecting said solid waste plastics to thermal cracking at a temperature in a range of 270–800° C. to obtain a thermal cracking product of partly gaseous hydrocarbons and partly a mixture of liquid hydrocarbons and residues;

(3) passing said gaseous hydrocarbons into a catalytic cracking reactor for catalytic cracking with an acid catalyst;

(4) sending said catalytically cracked gaseous hydrocarbons into a cooling portion to obtain liquid hydrocarbons of smaller molecules; and (5) said mixture of liquid hydrocarbons and residues from the thermal cracking portion being sent into a tubular continuous thermal cracking and residual discharging portion, in which the liquid hydrocarbons are gradually cracked into gaseous hydrocarbons when passing through the tubular continuous thermal cracking and residual discharge portion, while the dry residues from the previous thermal cracking and residues generated from the further thermal cracking are discharged at a residual discharging outlet of the continuous thermal cracking and residual discharge portion.

14. The method of claim 13, wherein gaseous hydrochloric acid contained in said gaseous hydrocarbons from the thermal cracking reactor and the continuous thermal cracking and residual discharging portion are sent to a hydrochloric acid removal portion for removing hydrochloric acid from said gaseous hydrocarbons to obtain chlorine free gaseous hydrocarbons before said catalytic cracking.

15. The method of claim 13, wherein said liquid hydrocarbons obtained from the cooling portion are passed into a pressurized activation reaction portion in which sulfur, nitrogen, and phosphorus contained in the liquid hydrocarbons are solidified so as to obtain purified hydrocarbon oils.

16. The method of claim 13, wherein said continuous thermal cracking in said continuous thermal cracking and residual discharging portion is carried out at a temperature range of 270–800° C.

17. The method of claim 14, wherein said hydrochloric acid removal reaction is carried out in presence of alkaline metallic substances at a temperature of 270–800° C.

18. The method of claim 13, wherein said cooling is a three-stage cooling, through which most of the gaseous hydrocarbons are turned into liquid hydrocarbons, and gaseous substances that are not convertible at room temperature and pressure are returned to the thermal cracking reactor and the continuous thermal cracking and residual discharge portion to generate additional heating for the thermal cracking.

19. The method of claim 15, further comprising a step of separation of hydrocarbon oils from the pressured activation reactor to obtain further purified hydrocarbon oils by means of a centrifuge.

20. A method of converting waste plastics into hydrocarbon oil, said method comprising the following steps of:

(1) feeding solid waste plastics into an oven thermal cracking reactor;

(2) subjecting said solid waste plastics to thermal cracking at a temperature in a range of 270–800° C. to obtain a thermal cracking product of partly gaseous hydrocarbons and partly a mixture of liquid hydrocarbons and residues;

(3) passing said gaseous hydrocarbons into a catalytic cracking reactor for catalytic cracking with an acid catalyst;

(4) sending said catalytically cracked gaseous hydrocarbons into a cooling portion to obtain liquid hydrocarbons of smaller molecules;

(5) passing said mixture of liquid hydrocarbons and residues into a continuous thermal cracking and residual discharging portion, in which the liquid hydrocarbons are gradually cracked into gaseous hydrocarbons when passing through the continuous thermal cracking and residual discharging portion, while the dry residues from the previous thermal cracking and residues newly generated from the further thermal cracking are discharged at a residual discharging outlet of the continuous thermal cracking and residual discharge portion; and (6) sending said gaseous hydrocarbons from the thermal cracking reactor and from the continuous thermal cracking and residual discharging portion to a hydrochloric acid removal portion for removing hydrochloric acid from said gaseous hydrocarbons to obtain chlorine free gaseous hydrocarbons before said catalytic cracking.

21. The method of claim 20, further comprising a step of passing said liquid hydrocarbons from said cooling stage into a pressurized activation reaction portion to have sulfur, nitrogen, and phosphorus contained in the liquid hydrocarbons solidified so as to obtain purified hydrocarbon oils.

22. The method of claim 20, wherein said continuous thermal cracking is carried out in a plurality of continuous reaction tubes of predetermined length parallel arranged at a temperature range of 270–800° C.

23. The method of claim 20, wherein said hydrochloric acid removal reaction is carried out in presence of alkaline metallic substances at a temperature range of 270–800° C.

24. The method of claim 20, wherein said catalytically cracked gaseous hydrocarbons are passed through three stages of cooling, such that most of the gaseous hydrocarbons are converted into liquid hydrocarbons of smaller molecules, while certain gaseous hydrocarbons that are not convertible at room temperature and pressure are led back the thermal cracking reactor and the continuous thermal cracking and residual discharge portion to compensate the heating capacity of thermal cracking.

25. The method of claim 21, wherein the liquid hydrocarbon oils is subject to a separation process by means of a centrifuge.

* * * * *